United States Patent [19]

Bowden et al.

[11] 4,390,610

[45] Jun. 28, 1983

[54] LAYERED ELECTROPHOTOGRAPHIC IMAGING ELEMENT, APPARATUS AND METHOD SENSITIVE TO GALLIUM ARSENIDE LASER, THE ELEMENT INCLUDING TWO CHARGE GENERATION LAYERS AND A POLYCARBONATE ADHESIVE LAYER

[75] Inventors: Larry D. Bowden, Boulder County; Albert H. Miyashita, Boulder; Charles I. Ravenelle, Longmont, all of Colo.

[73] Assignee: International Business Machines Corporation, Armonk, N.Y.

[21] Appl. No.: 316,368

[22] Filed: Oct. 29, 1981

[51] Int. Cl.[3] ..... G03G 5/06

[52] U.S. Cl. ..... 430/58; 430/72; 430/73

[58] Field of Search ..... 430/57, 58, 68, 72, 430/73

[56] References Cited

U.S. PATENT DOCUMENTS

| | | | |
|---|---|---|---|
| 3,588,242 | 6/1971 | Berlier et al. | 355/16 |
| 4,123,270 | 10/1978 | Heil et al. | 96/1.5 R |
| 4,150,987 | 4/1979 | Anderson et al. | 96/1.5 R |
| 4,278,746 | 7/1981 | Goto et al. | 430/58 |
| 4,307,167 | 12/1981 | Bowden et al. | 430/58 |

*Primary Examiner*—John E. Kittle
*Assistant Examiner*—John L. Goodrow
*Attorney, Agent, or Firm*—Francis A. Sirr

[57] ABSTRACT

A laser printer having a gallium arsenide laser and a photoconductor sensitive to the output wave energy of such a laser, the photoconductor having ordered layering of (1) a polycarbonate polymer adhesive layer coated onto an electrically conductive substrate, (2) a first CDB or TMB containing charge generating layer, (3) a second OHSQ containing charge generating layer, and (4) a top-located charge transport layer.

8 Claims, 2 Drawing Figures

LAYERED ELECTROPHOTOGRAPHIC IMAGING ELEMENT, APPARATUS AND METHOD SENSITIVE TO GALLIUM ARSENIDE LASER, THE ELEMENT INCLUDING TWO CHARGE GENERATION LAYERS AND A POLYCARBONATE ADHESIVE LAYER

TECHNICAL FIELD

This invention relates to photographic chemistry, processes and materials, and particularly to layered electrophotographic elements, process and materials.

BACKGROUND OF THE INVENTION

U.S. Pat. No. 4,123,270, incorporated herein by reference, discloses a layered electrophotographic imaging element of high sensitivity which has been successfully used in commercial electrophotographic reproduction devices.

Typically, a layered photoconductor of this type comprises an electrically conductive supporting substrate, covered by a charge generating layer, this layer in turn being covered by a charge transport layer. The layered photoconductor may be rigid or flexible, as its supporting substrate is rigid or flexible. An exemplary flexible substrate is aluminized polyethylene terephthalate film. Typically, the aluminum surface of such a film is coated with an adhesive layer of a suitable material such as polyester resin, of which PE 200 brand by B. F. Goodrich Chemical Company is a specific example. This adhesive layer is then meniscus coated with a charge generating photoconductive layer. U.S. Pat. No. 4,123,270 describes a charge generating layer of an organic dye material selected from organic primary amine soluble charge generating monoazo and disazo compounds, and from organic primary amine soluble charge generating derivatives of squaric acid. Example 1 of this patent describes the use of chlorodiane blue (CDB) as the charge generating layer, whereas example 26 of this patent describes the use of hydroxy squarylium; 2-4-bis-(2-hydroxy-4-dimethylaminophenyl)-1,3-cyclobutadiene-diylium-1,3-diolate; as the charge generating layer.

Copending and commonly assigned U.S. patent application Ser. No. 126,912, filed Mar. 3, 1980, now U.S. Pat. No. 4,307,167, in the name of L. D. Bowden et al, is also incorporated herein by reference. This patent describes the use of tetramethylbenzidine (TMB) as the charge generating layer of a layered photoconductor.

The final top layer of such a known layered imaging element is a charge transport layer. The p-type hydrazone containing charge transport layer of U.S. Pat. No. 4,150,987, incorporating herein by reference, is preferred. This patent is also of interest in that its example 6f suggests the use of polycarbonate as the aforementioned adhesive coating which coats the substrate's aluminum surface.

When a layered photoconductor is formulated in accordance with example 1 of U.S. Pat. No. 4,123,270, using the charge transport layer of U.S. Pat. No. 4,150,987, the result is a very acceptable electrophotographic imaging element of superior properties such as low light fatigue, low dark fatigue, low dark decay and acceptable sensitivity. However, the imaging element is not sensitive, to an acceptable degree, to the radiant energy output of a gallium arsenide laser.

The advent of so-called laser printers, which utilize electrophotographic reproduction devices, makes such sensitivity a desirable feature of an imaging element. The spectral output of a gallium arsenide laser is maximum at about 8200 angstroms.

A layered photoconductor in accordance with example 26 of U.S. Pat. No. 4,123,270 does in fact possess acceptable sensitivity to the output of such a laser. However, this photoconductor is not entirely acceptable in the areas of light fatigue, dark fatigue and dark decay.

The foregoing and other features and advantages of the invention will be apparent from the following more particular description of preferred embodiments of the invention, as illustrated in the accompanying drawing.

THE INVENTION

The present invention is based upon the discovery that a layered electrophotographic imaging element, which is sensitive to the output of a gallium arsenide laser and possesses acceptable dark fatigue, light fatigue, dark decay and sensitivity, results from a particular layering-order of (1) a polycarbonate polymer adhesive layer coating the electrically conductive substrate, (2) a first CDB or TMB (tetramethylbenzidene) charge generating layer, (3) a second hydroxy squarylium (OHSQ) charge generating layer, and (4) a top-located charge transport layer.

It is not understood why such a layered photoconductor produces this surprising result. Polycarbonate, of a wide range of molecular weights, is the only known adhesive layer which will produce synergistic results in combination with the required order of a CDB or TMB layer on top of the polycarbonate layer, and an OHSQ layer coating the CDB or TMB layer.

Whatever the explanation for the observed results, the composition of the top-located charge transport layer does not appear to be critical, other than that, for example, when the imaging element is charged to a negative DC voltage in its electrophotographic device, a p-type transport material is required.

Figure 1:
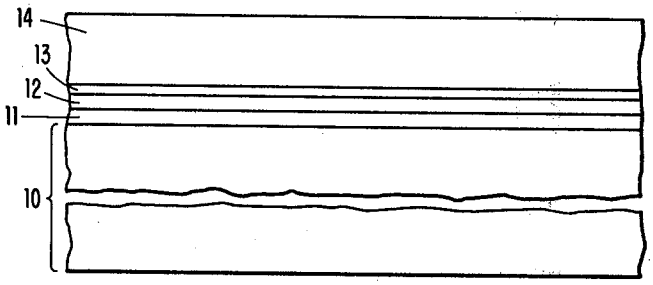
FIG. 1 is an exaggerated-size side view of the layered photoconductor of this invention.

The layered photoconductor of the present invention is shown in FIG. 1. in this figure reference number 10 is the aforesaid electrically conductive substrate, for example a 3-mil thick web of aluminized polyethylene terephthalate film which is about 17 inches wide. The aluminized top surface of this substrate is coated with a continuous layer 11 of a polycarbonate polymer to a dry thickness in the range of from 0.05 to 0.20 micrometer. While the molecular weight of this polymer is not critical, an example is 60,000. A preferred polycarbonate polymer is the brand M-60 available from Mobay Chemical Company.

The aforesaid first charge generating layer 12 is then coated onto layer 11 to a dry thickness in the range of 0.05 to 0.20 micrometer, to form a 0.03 to 0.20 milligram per square inch, by weight, continuous layer. Continuous layer 13 is the second aforesaid charge generating layer, and this layer is coated to a dry thickness of from 0.03 to 0.15 micrometer. The last layer 14 is the aforesaid charge transport layer. This layer is also continuous, and is coated to a dry thickness of from 10 to 20 micrometers.

The method of preparing the layered photoconductor of FIG. 1 is not critical to the present invention. The method of making as described in aforementioned U.S. Pat. No. 4,150,987 is recommended. Layer 14, i.e., the dry OHSQ charge generating layer, preferably comprises about 3 wt.% amines and 97 wt.% THF. More specifically, about 0.5 gram of OHSQ, 6 milliliters (mls) of ethylenediamine (EDA) and 192 mls of tetrahydrofuran (THF) are prepared as follows: to 0.5 gram of OHSQ, add 6 mls of EDA and allow the OHSQ to dissolve. This takes about three minutes. After dissolution has occurred, add 192 mls of THF. The coating solution for achieving FIG. 1's layer 14 is now prepared. This solution can now be coated as described in U.S. Pat. No. 4,150,987.

Figure 2:
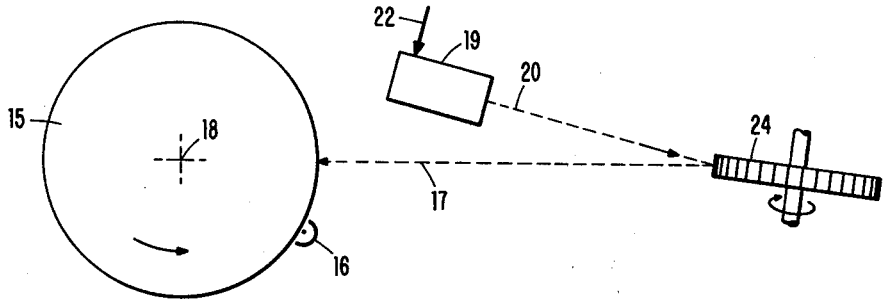
FIG. 2 is a portion of an exemplary laser printer using the photoconductor of FIG. 1.

FIG. 2 shows the photoconductor of FIG. 1 mounted on rotating drum 15 having axial length somewhat longer than the width of the photoconductor. An exemplary drum is shown in U.S. Pat. No. 3,588,242. The photoconductor is carried on the external cylindrical surface of the drum and its top layer 14 faces outward to be charged by corona 16. In FIG. 2 corona 16 charges the photoconductor's p-type hydrazone charge transport layer 14 to about negative 850 volts. Thereafter, the charged photoconductor is subjected to a scanning laser beam 17 which scans the drum parallel to its cylindrical axis of rotation 18. Laser 19 is a gallium arsenide laser. The laser is controlled by an electrical signal 22 comprising image data input to the printer. The laser's resulting output 20 strikes rotating polygon mirror 24 and produces scanning beam 17. Beam 17 strikes the photoconductor, and discharges the same to about −150 V, whenever the visual reproduction of the image data input should be devoid of toner. At the remaining areas, which are to be toned, the photoconductor voltage remains at about −850 V.

The details of modulating a gallium arsenide laser are well known, as are beam sweeping techniques. The latter can be, for example, that of the commercially available IBM 6670 Information Distributor.

The moving photoconductor, downstream of scanning beam 17, carries a −850 V electrostatic latent image as a reproduction of image data input 22. As is conventional, this latent image is toned, by developer means not shown, and this visible toner image is then transferred to copy material such as paper, by means also not shown.

While the invention has been particularly shown and described with reference to preferred embodiments thereof, it will be understood by those skilled in the art that various changes in form and details may be made therein without departing from the spirit and scope of the invention.

What is claimed is:

1. A layered electrophotographic imaging element, having a spectral sensitivity compatible with the spectral output of a gallium arsenide layer, which spectral output is maximum at about 8200 angstroms, said element comprising:

an electrically conductive layer;

a layer of polycarbonate polymer on said conductive layer and acting as an adhesive layer for a first charge generating layer containing an active charge generating constituent selected from the group chlorodiane blue and tetramethylbenzidine, located on said polycarbonate layer;

a second charge generating layer on said first charge generating layer and containing hydroxy squarylium as its active charge generating constituent; and a charge transport layer on said second charge generating layer.

2. The layered element of claim 1 wherein said charge transport layer is p-type material.

3. The layered element of claim 2 wherein said p-type material is a hydrazone.

4. An electrophotographic process comprising:

negatively charging in the dark the surface of an electrophotographic imaging element comprising in ordered layers: a conductive substrate, a polycarbonate polymer layer, a first charge generating layer whose active material is selected from the group CDB and TMB, a second charge generating layer whose active material is OHSQ, and a p-type charge transport layer; and exposing the imaging element to an imagewise pattern of radiation output provided by a gallium arsenide laser.

5. The process defined by claim 4 wherein the charge transport material of said imaging element is a p-type hydrazone.

6. An electrophotographic device, comprising:

a layered photoconductor having a layering-order of a polycarbonate polymer adhesive on an electrically conductive substrate; a first charge generating layer on said adhesive layer and containing an active charge generating constituent selected from the group CDB and TMB; a second charge generating layer on said first charge generating layer and containing hydroxy squarylium as its active charge generating constituent; and a charge transport layer on said second charge generating layer;

means for applying an activating charge to said photoconductor; and gallium arsenide laser means operable to selectively discharge said charged photoconductor in accordance with electrical image data input.

7. The device of claim 6 wherein said means for applying an activating charge is operable to charge said photoconductor to a negative polarity, and wherein said photoconductor's charge transport layer is p-type.

8. The device of claim 7 wherein said p-type charge transport layer is a hydrazone.

* * * * *